US007183889B2

(12) United States Patent
Fushimi

(10) Patent No.: US 7,183,889 B2
(45) Date of Patent: Feb. 27, 2007

(54) HIGH-VOLTAGE TRANSFORMER

(75) Inventor: Tadayuki Fushimi, Tokyo (JP)

(73) Assignee: Sumida Corporation, Tokyo (JP)

( * ) Notice: Subject to any disclaimer, the term of this patent is extended or adjusted under 35 U.S.C. 154(b) by 14 days.

(21) Appl. No.: 11/100,434

(22) Filed: Apr. 7, 2005

(65) Prior Publication Data

US 2005/0237145 A1 Oct. 27, 2005

(30) Foreign Application Priority Data

Apr. 26, 2004 (JP) ..... 2004-129469

(51) Int. Cl.
*H01F 27/24* (2006.01)
*H01F 27/30* (2006.01)

(52) U.S. Cl. ..... 336/208; 336/198; 336/212

(58) Field of Classification Search ..... 336/198, 336/192, 212, 210, 200, 208; 315/219
See application file for complete search history.

(56) References Cited

U.S. PATENT DOCUMENTS 6,154,113 A * 11/2000 Murai ..... 336/198
6,714,111 B2 * 3/2004 Suzuki ..... 336/110
6,876,161 B2 * 4/2005 Chung ..... 315/368.28

FOREIGN PATENT DOCUMENTS

| | | | |
|---|---|---|---|
| JP | 10149932 A | * | 6/1998 |
| JP | 10-208956 | | 8/1998 |
| JP | 10241972 A | * | 9/1998 |
| JP | 2001-267156 | | 9/2001 |
| JP | 2004-031647 | | 1/2004 |

* cited by examiner

*Primary Examiner*—Anh Mai
(74) *Attorney, Agent, or Firm*—Snider & Associates; Ronald R. Snider

(57) ABSTRACT

A high-voltage transformer 11 is provided with first and second bobbins 21A, 21B wound with primary windings 45A, 45B and secondary windings 46A, 46B respectively, I-shaped first and second cores 30A, 30B fitted into the bobbins 21A, 21B and an H-shaped third core 31 interposed between the cores 30A, 30B. The core 30A and core 31 form a first magnetic circuit and the core 30B and core 31 form a second magnetic circuit, and the primary windings 45A, 45B around the bobbins 21A, 21B are wound in the same direction so that the orientations of magnetic flux in both magnetic circuits match inside the core 31.

6 Claims, 5 Drawing Sheets

HIGH-VOLTAGE TRANSFORMER

RELATED APPLICATION

This application claims the priority of Japanese Patent Application No. 2004-129469 filed on Apr. 26, 2004, which is incorporated herein by reference.

BACKGROUND OF THE INVENTION

1. Field of the Invention

The present invention relates to a high-voltage transformer used for a lighting circuit of a backlight discharge lamp on a liquid crystal display panel, and more particularly, to a double transformer type high-voltage transformer which integrates two transformer sections in a single body.

2. Description of the Prior Art

Conventionally, a transformer for a backlight of various types of liquid crystal display panel used for a notebook personal computer, etc., capable of simultaneously discharging and lighting a plurality of cold cathode discharge lamps (hereinafter referred to as "CCFL") is known. Using a plurality of CCFLs can meet demands for enhanced brightness and uniform illumination etc., of a liquid crystal display panel.

As this type of circuit for lighting CCFLs, an inverter circuit which transforms a DC voltage of approximately 12 V to a high-frequency voltage of approximately 2000 V at 60 kHz using a high-voltage transformer and starts discharging is generally used.

It should be noted that since such a high-voltage transformer (inverter transformer) is mounted on a board and set in a predetermined space such as a liquid crystal display panel apparatus, there is a demand for a drastic reduction in size and profile in response to requests for a smaller and slimmer liquid crystal display panel apparatus, etc. Furthermore, in order to promote the downsizing of the apparatus, there is also a strong demand for the development of a technology which allows a single high-voltage transformer to light a plurality of CCFLs.

As a conventional high-voltage transformer capable of lighting a plurality of CCFLs, an inverter transformer having an open magnetic circuit structure described in Japanese Unexamined Patent Publication No. 2001-267156 is known. The inverter transformer described in Japanese Unexamined Patent Publication No. 2001-267156 is provided with a plurality of bar-like magnetic cores formed independently for a common primary winding with each of the plurality of bar-like magnetic cores wound with a secondary winding so as to light the plurality of CCFLs.

However, the transformer described in Japanese Unexamined Patent Publication No. 2001-267156 mentioned above has the primary winding common to the plurality of secondary windings and if, for example, a load of one CCFL fluctuates, outputs to other CCFLs also fluctuate. Furthermore, even CCFLs of the same specification have variations in their characteristics and use of such a common primary winding results in unstable lighting of other CCFLs because of variations in their individual characteristics.

Furthermore, the transformer described in Japanese Unexamined Patent Publication No. 2001-267156 uses a common primary winding and requires only a small number of working steps and has apparently excellent operability, but at least the primary winding must be provided after a plurality of bobbins have been assembled, which makes winding on tiny high-voltage transformers difficult and contrarily reduces the work efficiency as a whole.

Japanese Unexamined Patent Publication No. HEI 10-208956 discloses a high-voltage transformer having a closed magnetic circuit structure integrating two transformer sections into one body, but even if outputs are supplied to two CCFLs independently, magnetic interference is produced and it is difficult to actually operate them as double transformers. That is, the transformer described in this Publication is intended to obtain a high current capacity and low DC resistance by connecting the winding start tip and winding end tip of the two secondary windings and has a structure and object totally different from those of the present invention.

The present invention has been implemented in view of the above described circumstances and it is an object of the present invention to provide a high-voltage transformer capable of simultaneously driving a plurality of loads with a single high-voltage transformer, of an independent output type which prevents fluctuations of each load from affecting the driving of other loads and capable of avoiding any reduction in the efficiency of winding operation.

SUMMARY OF THE INVENTION

A first high-voltage transformer of the present invention capable of attaining such an object comprises first and second bobbins wound with a primary winding and a secondary winding respectively, each having a hollow section, first and second cores fitted into the hollow sections of these first and second bobbins and a third core disposed close to these first and second cores, wherein the first core and the third core form a first magnetic circuit and the second core and the third core form a second magnetic circuit, and the winding direction of the primary windings around the first and second bobbins is adjusted so that the orientation of magnetic flux in the first magnetic circuit matches the orientation of magnetic flux in the second magnetic circuit inside the third core.

Furthermore, the first and second cores are preferably I-shaped cores of substantially the same shape, the third core has a sideway H-shaped core, these two I-shaped cores are arranged substantially in parallel, the H-shaped core is interposed between these two I-shaped cores, these three cores are combined together to form a shape like a number "8" when represented by a 7 segment LED and both the first magnetic circuit and the second magnetic circuit are formed as closed magnetic circuits.

Furthermore, the leading edges of the primary windings around the first and second bobbins and the trailing edges thereof are set to substantially equivalent potentials and the primary windings have the same winding direction.

In the first and second bobbins, the winding areas of the primary winding and the secondary winding are preferably formed separate from each other in the axial direction of the bobbins and the sideway H-shaped core is preferably shaped in such a way that the portions of the winding areas of the secondary windings around the first and second bobbins at least facing the high-voltage side are notched.

Furthermore, the first, second and third cores are preferably placed on winding terminal blocks.

The first, second and third cores are preferably formed of ferrite.

Furthermore, a second high-voltage transformer of the present invention comprises first and second E-shaped cores, each having three substantially parallel arm sections, these two cores being combined together so that end faces of corresponding arm sections face each other to form a shape like a number "8" when represented by a 7 segment LED, wherein the two arm sections located at both ends out of the three parallel arm sections made up of the arm sections of the two cores and the two arm sections combined together are fitted into hollow sections of bobbins wound with a primary winding and a secondary winding respectively, wherein the two arm sections located at both ends are used as the first and second arm combining sections and the arm section located in the center is used as a third arm combining section, the first arm combining section and the third arm combining section form a first magnetic circuit and the second arm combining section and the third arm combining section form a second magnetic circuit, and the winding direction of the primary winding around each bobbin into which each of the two arm combining sections is fitted is adjusted so that the orientation of magnetic flux in the first magnetic circuit matches the orientation of magnetic flux in the second magnetic circuit inside the third arm combining section.

Furthermore, the portions wound with the secondary windings of the first and second bobbins may be divided into a plurality of sections by insulating partition plates.

When this specification refers to the winding directions of the two bobbins, they will be explained assuming that their winding directions are the same, but the present invention, of course, is not limited to this.

According to the first high-voltage transformer, the core section is constructed of the first and second cores fitted into the first and second bobbins, and the third core disposed between these two cores, the first core and third core form the first magnetic circuit and the second core and third core form the second magnetic circuit. The first magnetic circuit produces a predetermined high voltage in the secondary winding wound around the first bobbin and the second magnetic circuit produces a predetermined high voltage in the secondary winding wound around the second bobbin. In this case, a shared magnetic circuit is formed in the third core. By adjusting the winding direction of the primary windings around the first and second bobbins so that the orientations of magnetic fluxes in the two magnetic circuits match inside the third core, it is possible to prevent generation of magnetic interference and secure the effectiveness of the shared magnetic circuit, and thereby obtain continuously stable and desired outputs from the respective secondary windings.

Furthermore, since the respective components can be combined after the respective windings are wound around the bobbins on the primary and secondary sides, it is possible to avoid the efficiency of winding operation from reducing despite the double transformer structure.

Furthermore, since two mutually independent magnetic circuits are formed and at the same time the third core which forms the shared magnetic circuit is provided on part thereof, it is possible to reduce the number of parts, manufacturing cost and the size of the apparatus compared to a case where two completely independent high-voltage transformers, each having a closed magnetic circuit structure, are used.

Furthermore, the second high-voltage transformer of the present invention comprises E-shaped first and second cores each having three substantially parallel arm sections, the two cores being combined so that the end faces of the corresponding arm sections face each other, wherein the bobbins wound with a primary winding and a secondary winding respectively are fitted into the two arm combining sections located relatively at both ends out of the three arm combining sections formed by combining the arm sections of the two cores, and when the arm sections located at both ends are used as the first and second arm combining sections and the arm section located in the center is used as a third arm combining section, the first arm combining section and the third arm combining section form a first magnetic circuit and the second arm combining section and the third arm combining section form a second magnetic circuit. Then, the first magnetic circuit generates a predetermined high voltage for the secondary winding wound around one bobbin and the second magnetic circuit generates a predetermined high voltage for the secondary winding wound around the other bobbin. In this case, a shared magnetic circuit is formed in the third arm combining section, but by adjusting the winding direction of the primary winding on each bobbin, it is possible to cause magnetic fluxes in the two magnetic circuits inside the third arm combining section to have the same orientation, prevent magnetic interference, secure the effectiveness of the shared magnetic circuit and thereby obtain continuously stable, desired outputs from the respective secondary windings.

Therefore, the second high-voltage transformer of the present invention can also have the same effects as those of the above described first high-voltage transformer.

DETAILED DESCRIPTION OF THE PREFERRED EMBODIMENTS

With reference now to the attached drawings, a high-voltage transformer according to an embodiment of the present invention will be explained in detail below.

Figure 1:
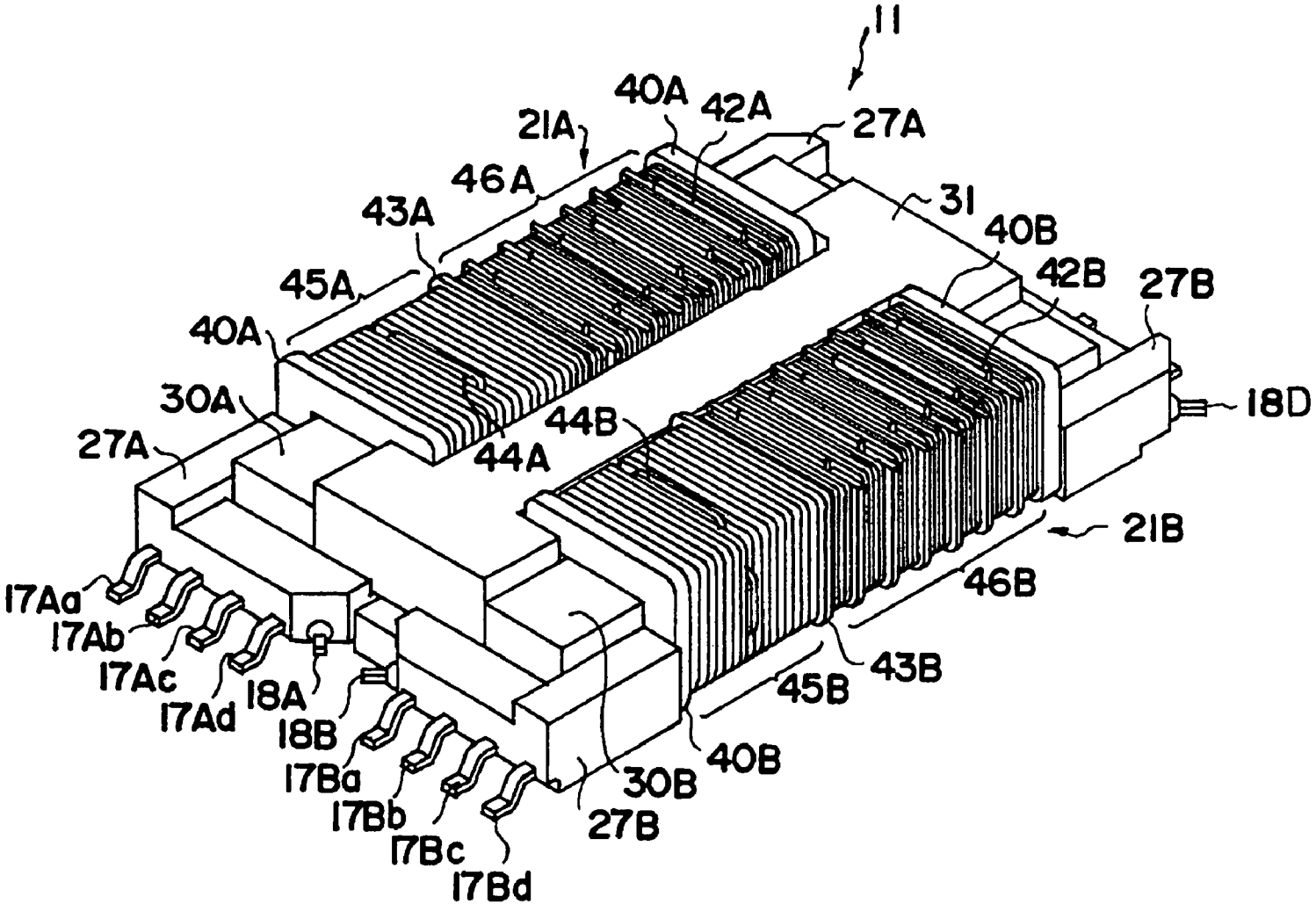
FIG. 1 is a perspective view showing a high-voltage transformer according to an embodiment of the present invention.
Figure 2:
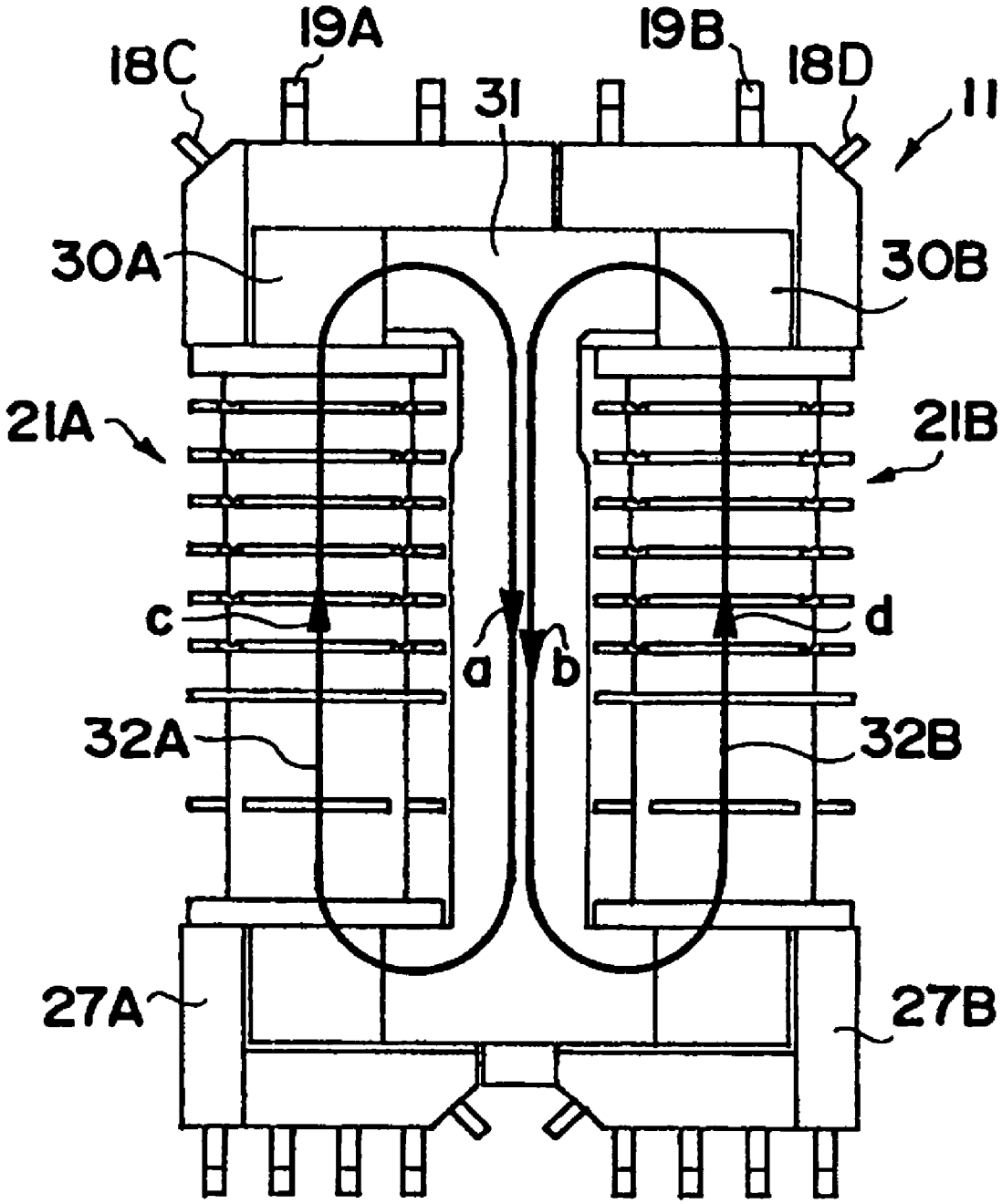
FIG. 2 is a plan view showing the high-voltage transformer according to the embodiment of the present invention.
Figure 3:
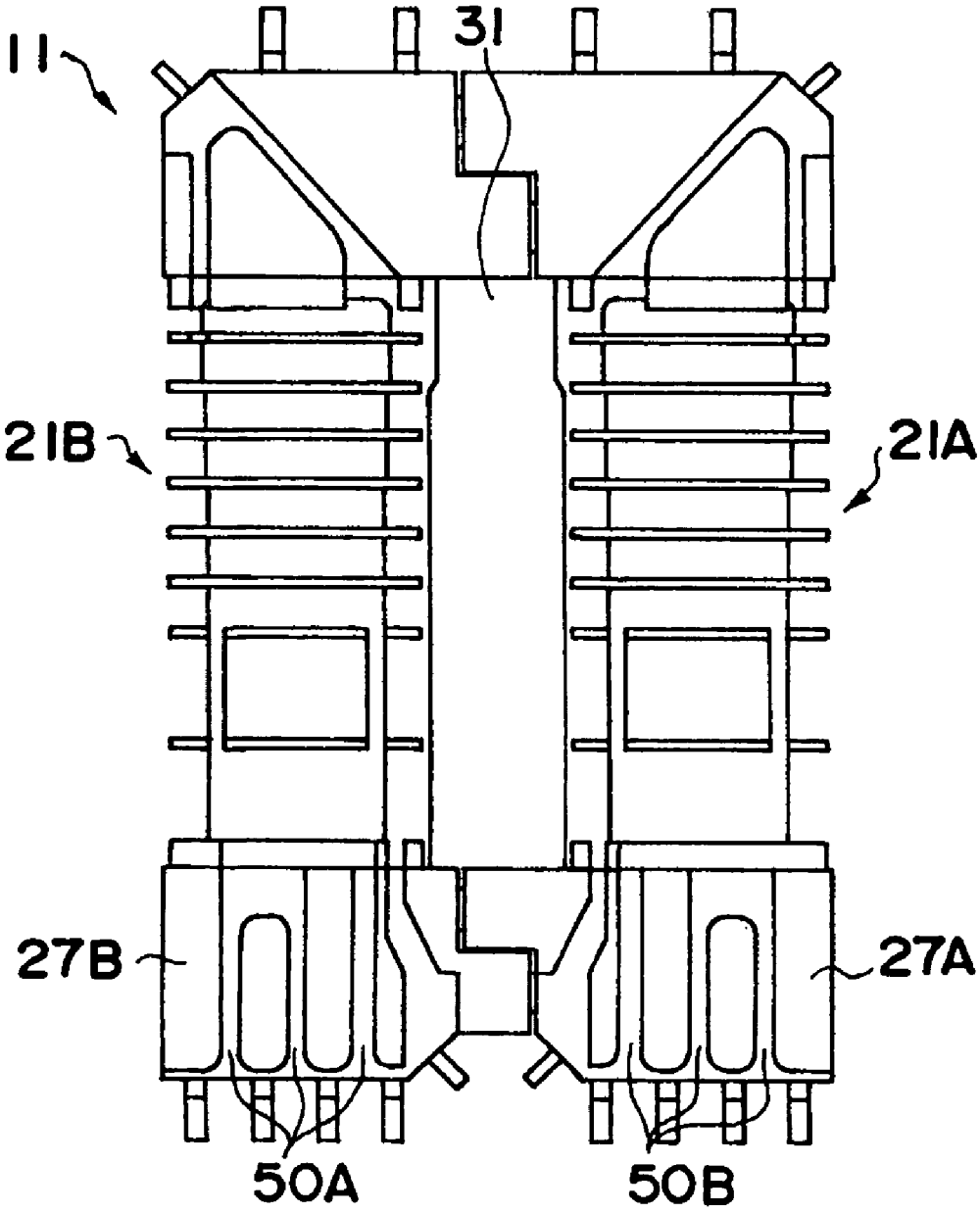
FIG. 3 is a bottom view showing the high-voltage transformer according to the embodiment of the present invention.
Figure 4:
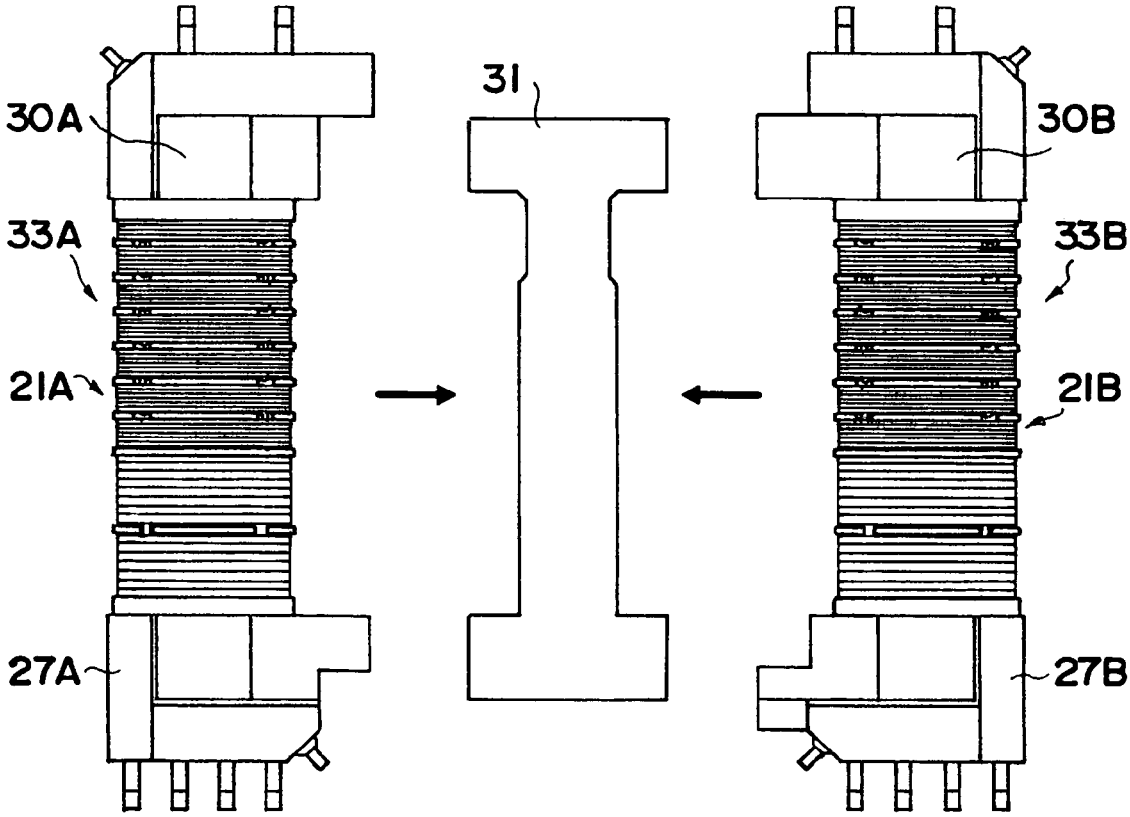
FIG. 4 is an exploded view showing the high-voltage transformer according to the embodiment of the present invention.

FIG. 1 is a perspective view showing a high-voltage transformer according to an embodiment of the present invention, FIG. 2 is a plan view thereof, FIG. 3 is a bottom view thereof, FIG. 4 is an exploded view thereof, and FIG. 2 and FIG. 3 show the high-voltage transformer with windings omitted for convenience of explanation.

The high-voltage transformer 11 of this embodiment is also called "double-leakage transformer" and is an inverter transformer used in a DC/AC inverter circuit to discharge and light two CCFLs (cold cathode discharge lamps) simultaneously.

This high-voltage transformer 11 is provided with a first bobbin 21A and a second bobbin 21B having hollow sections inside, wound with primary windings 45A, 45B and secondary windings 46A, 46B respectively, I-shaped first core 30A and second core 30B fitted into the hollow sections of these two bobbins 21A, 21B and an H-shaped third core 31 interposed between these two cores 30A, 30B.

The primary windings 45A, 45B and secondary windings 46A, 46B wound around the respective bobbins 21A, 21B are electromagnetically coupled by the medium of the corresponding I-shaped cores 30A, 30B.

The secondary windings 46A, 46B are wound around the axes of the I-shaped cores 30A, 30B, but to prevent a high voltage difference between neighboring windings from occurring and causing dielectric breakdown, they are divided into a plurality of sections in the axial directions and insulating partition plates 42A, 42B are provided between neighboring sections to secure an insulating distance necessary to block creeping discharge. Furthermore, insulating partition plates 43A, 43B are provided between the primary windings 45A, 45B and secondary windings 46A, 46B, too. It is also possible to divide the primary windings 45A, 45B into a plurality of sections using insulating partition plates 44A, 44B as appropriate.

Furthermore, the bobbins 21A, 21B have a tubular shape with a rectangular cross-section and the primary windings 45A, 45B and secondary windings 46A, 46B are wound around the outer surfaces of the bobbins 21A, 21B thereof and flanges 40A, 40B are provided on both end faces of the bobbins 21A, 21B.

Furthermore, the first core 30A and second core 30B are electromagnetically coupled with the third core 31 which is made of the same ferrite material as that of the cores 30A, 30B and these form a magnetic circuit. The magnetic circuit will be explained later.

Furthermore, a tiny gap is formed between the I-shaped cores 30A, 30B and H-shaped core 31 and the amount of gap is determined by the extent to which leaked magnetic flux is produced and this amount of gap can also be reduced to substantially 0.

Furthermore, these three cores 30A, 30B, 31 are placed on winding terminal blocks 27A, 27B made of insulators.

Furthermore, the leading edges and trailing edges of the primary windings 45A, 45B are connected to terminal pins 17Aa, 17Bd, 17Ab, 17Bc which are held and fixed to the winding terminal blocks 27A, 27B and the leading edges of the secondary windings 46A, 46B are connected to terminal pins 17Ad, 17Ba which are held and fixed to the winding terminal blocks 27A, 27B, while their trailing edges are connected to terminal pins 19A, 19B (see FIG. 2) which are held and fixed to the winding terminal blocks 27A, 27B. Furthermore, winding terminals 18A to 18D (see FIGS. 1 and 2) are formed for provisional connections of the windings. The modes of connections of the primary windings 45A, 45B and secondary windings 46A, 46B to the terminal pins 17Aa to 17Ad, 17Ba to 17Bd and 19A, 19B are not limited to them. Furthermore, in this embodiment, the leading edges of the primary windings 45A, 45B are electrically connected to each other and the trailing edges thereof are also electrically connected to each other. In this embodiment, the respective leading edges are set on the high voltage side and the respective trailing edges are set on the low voltage side.

The high-voltage transformer of this embodiment is constructed in such a way that one H-shaped third core 31 is interposed between two I-shaped first and second cores 30A, 30B and as shown in FIG. 2, the first core 30A and third core 31 form a first magnetic circuit 32A and the second core 30B and third core 31 form a second magnetic circuit 32B. As described above, though a tiny magnetic gap is formed between the first and second cores 30A, 30B and the third core 31, these first and second magnetic circuits 32A, 32B are formed as closed magnetic circuits as a whole.

In order for the orientation of magnetic flux (direction indicated by arrow a) in the first magnetic circuit 32A to match the orientation of magnetic flux (direction indicated by arrow b) in the second magnetic circuit 32B inside the third core 31, the primary windings 45A, 45B are wound around the first and second bobbins 21A, 21B in the same direction.

In this embodiment, voltages are applied to the primary windings 45A, 45B in parallel and two CCFLs are allowed to discharge and light up simultaneously by outputs from the respective secondary windings 46A, 46B.

That is, the primary windings 45A, 45B are arranged in parallel, the leading edges of the primary windings 45A, 45B are electrically connected to each other and the trailing edges thereof are electrically connected to each other, the primary windings 45A, 45B are wound in the same direction and the orientations of the magnetic fluxes inside the first and second cores 30A, 30B (directions indicated by arrows c, d) are the same, and therefore the orientation of magnetic flux in the first magnetic circuit 32A is the same as the orientation of magnetic flux in the second magnetic circuit 32B inside the third core 31. Therefore, there is no possibility that magnetic interference may occur inside the third core 31 and it is possible to stably operate the two CCFLs independently from each other.

Furthermore, as shown in FIG. 4, the high-voltage transformer according to this embodiment is formed by combining a first transformer section 33A made up of the first bobbin 21A, first core 30A and first winding terminal block 27A, a second transformer section 33B made up of the second bobbin 21B, second core 30B and second winding terminal block 27B, and the third core 31. Furthermore, in the respective transformer sections 33A, 33B, the windings are wound around the bobbins 21A, 21B independently from each other. This prevents the winding operation from becoming complicated as in the case of the transformer described in aforementioned Japanese Unexamined Patent Publication No. 2001-267156 in which the primary winding is shared, and can prevent any reduction of manufacturing efficiency.

In the case where the secondary windings 46A, 46B around the first and second bobbins 21A, 21B are connected in parallel to each other and two CCFLs are driven independently from each other, it is preferable to match the winding directions of the secondary windings 46A, 46B from the standpoint of simplification of manufacturing steps, etc. However, the high-voltage transformer of this embodiment is not limited to this, and when, for example, U-shaped CCFLs requiring high-voltage driving are lit, it is preferable to connect the trailing edge of the secondary winding 46A of the first transformer section 33A to one end of the CCFL, connect the trailing edge of the secondary winding 46B of the second transformer section 33B to the other end of the CCFL and construct the transformer so that the outputs of the respective trailing edges have mutually opposite phases, therefore in this case, the winding directions of the secondary windings 46A, 46B are opposite to each other.

Furthermore, as shown in FIGS. 1, 2 and 4, in the high-voltage transformer 11 of this embodiment, the portions of the third core 31 facing the high-voltage winding areas of the secondary windings 46A, 46B are slightly notched. This causes the windings to be separated from the surfaces of the sides of the third core 31 in the portions facing the high-voltage winding areas of the secondary windings 46A, 46B, secures an insulating distance that can block creeping discharge, and can thereby obtain a high-voltage transformer with a high withstand voltage which reduces the likelihood of dielectric breakdown.

The high-voltage transformer of the present invention is not limited to the one described in the foregoing embodiment and can be modified in various modes. For example, the first and second cores 30A, 30B are I-shaped and the third core 31 is H-shaped, but they are not limited to such shapes.

Figure 5:
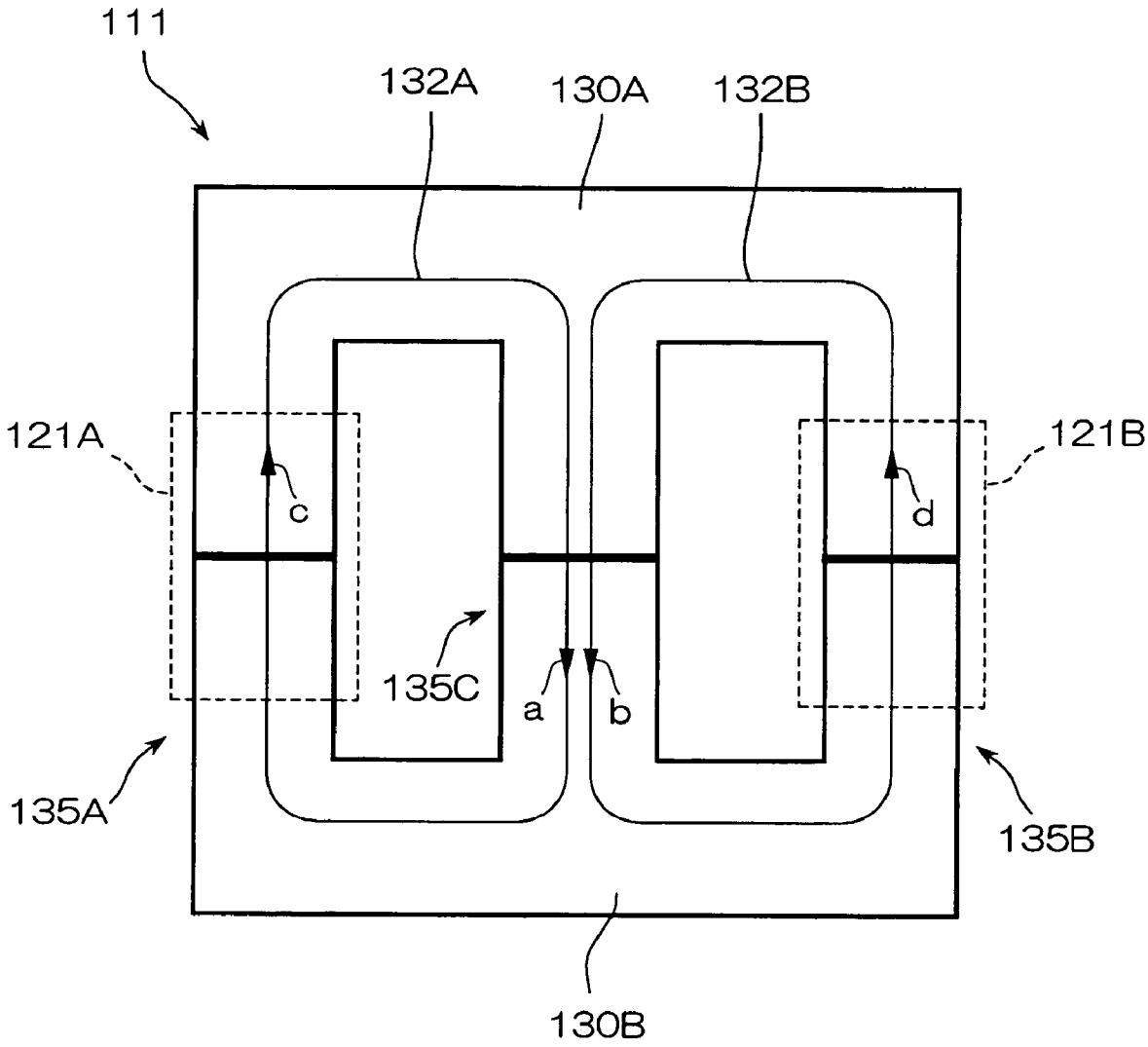
FIG. 5 is a conceptual view of a high-voltage transformer according to another embodiment of the present invention.

For example, as a high-voltage transformer 111 shown in a conceptual view in FIG. 5, it is possible to have a first core 130A and a second core 130B which include three parallel arm sections making up E-shaped cores, combine these cores 130A, 130B in such a way that the end faces of the corresponding arm sections face each other, roughly forming a shape like a number "8" when represented by a 7 segment LED. In this case, when the two arm combining sections 135A, 135B located relatively at both ends out of the three arm combining sections 135A, 135B, 135C formed by combining the respective arm sections of the two cores 130A, 130B are fitted into the first and second bobbins 121A, 121B (only conceptually outlined by dotted lines) wound with a primary winding and a secondary winding, and each having a hollow section. When the first and second arm combining sections 135A, 135B are used as the arm combining sections located at both ends and the third arm combining section 135C located in the center is used as the arm combining section, the first arm combining section 135A and third arm combining section 135C form a first magnetic circuit 132A and the second arm combining section 135B and third arm combining section 135C form a second magnetic circuit 132B. The winding direction of the primary winding around the first and second bobbins 121A, 121B is adjusted so that the orientation c of magnetic flux in the first magnetic circuit 132A matches the orientation d of magnetic flux in the second magnetic circuit 132B (see arrows a, b) inside the third arm combining section 135C.

The characteristic parts of the aforementioned embodiments (FIGS. 1 to 4) in the high-voltage transformer 111 shown in FIG. 5 can be used for any parts other than those explained above.

The cross-sectional shape of each core is not limited to a specific shape such as rectangle either and any shape such as circle or elliptic can be used if it at least allows the cores to be inserted into the hollow sections of the bobbins.

Moreover, as described above, the first, second and third cores are preferably formed of ferrite, but it is also possible to use materials such as permalloy, sendust, iron carbonyl and it is also possible to use a dust core obtained by compressing and molding fine powder thereof.

Furthermore, the high-voltage transformer of the present invention is applicable not only to an inverter transformer but also to various other types of transformers.

Furthermore, the load to be driven by the transformer is not limited to the above described CCFL.

What is claimed is:

1. A high-voltage transformer comprising:

first and second bobbins having hollow sections, wound with a primary winding and a secondary winding respectively;

first and second cores fitted into said hollow sections of the first and second bobbins; and a third core disposed close to the first and second cores, wherein said first core and said third core form a first magnetic circuit and said second core and said third core form a second magnetic circuit, and the winding direction of said primary windings around said first and second bobbins is adjusted so that the orientation of magnetic flux in said first magnetic circuit matches the orientation of magnetic flux in said second magnetic circuit inside said third core wherein said first and second cores are I-shaped cores of substantially the same shape, said third core is a sideway H-shaped core, the two I-shaped cores are arranged substantially in parallel, said H-shaped core is interposed between the two I-shaped cores and the three cores are combined together to form a shape like a number "8" when represented by a 7 segment LED and both said first magnetic circuit and said second magnetic circuit are formed as closed magnetic circuits.

2. The high-voltage transformer according to claim 1, wherein the leading edges of said primary windings around said first and second bobbins and the trailing edges thereof are set to substantially equivalent potentials and the primary windings have the same winding direction.

3. The high-voltage transformer according to claim 1, wherein winding areas of said primary winding and said secondary winding around said first and second bobbins are formed to be separate from each other in the axial direction of the bobbins, and portions of said H-shaped core at least facing the high-voltage sides of winding areas of said secondary windings around said first and second bobbins are notched.

4. The high-voltage transformer according to claim 1, wherein the portions wound with said secondary windings of said first and second bobbins are divided into a plurality of sections by insulating partition plates.

5. The high-voltage transformer according to claim 1, wherein said first, second and third cores are placed on winding terminal blocks.

6. The high-voltage transformer according to claim 1, wherein said first, second and third cores are formed of ferrite.

* * * * *